US007285709B2

(12) United States Patent
White et al.

(10) Patent No.: US 7,285,709 B2
(45) Date of Patent: Oct. 23, 2007

(54) MODULAR AUTOMATED ASSISTIVE GUITAR

(76) Inventors: Christina Kay White, 12817 Withers Way, Austin, TX (US) 78727; Atif Muzaffar Qureshi, 6623 Seegers Trail Dr., Houston, TX (US) 77066-3831; Vikramjit Singh, 400 E. 30th St., Apt. #101, Austin, TX (US) 78705; Jarden Ellison Krager, 1010 W. Rundberg Ln. #2, Austin, TX (US) 78758; Jennifer Elizabeth Porlier, 66 Hessenford St., Sugar Land, TX (US) 77479; Kristin Lee Wood, 13700 Evergreen Way, Austin, TX (US) 78737; Richard Haygood Crawford, Jr., 912 Lipan Trail, Austin, TX (US) 78733

( * ) Notice: Subject to any disclaimer, the term of this patent is extended or adjusted under 35 U.S.C. 154(b) by 7 days.

(21) Appl. No.: 11/298,837

(22) Filed: Dec. 9, 2005

(65) Prior Publication Data

US 2007/0131080 A1 Jun. 14, 2007

(51) Int. Cl.
*G10D 3/16* (2006.01)
*G10F 1/20* (2006.01)

(52) U.S. Cl. ..... 84/321; 84/8; 84/267; 84/320; 84/315; 984/116

(58) Field of Classification Search ..... 84/8, 84/267, 317, 320, 321, 315; 984/116
See application file for complete search history.

(56) References Cited

U.S. PATENT DOCUMENTS 948,474 A * 2/1910 Cartmell ..... 84/8
999,427 A * 8/1911 Bajde ..... 84/315
1,018,384 A * 2/1912 Wauters ..... 84/10
1,094,819 A * 4/1914 Sandell ..... 84/11
1,871,021 A * 8/1932 Zachrison ..... 84/8
3,443,468 A * 5/1969 Kidwell ..... 84/315
3,568,560 A * 3/1971 Chang et al. ..... 84/317
4,024,787 A 5/1977 Larson
4,030,400 A 6/1977 Del Castillo
4,331,059 A 5/1982 Marabotto
4,428,273 A 1/1984 Favron
4,566,365 A 1/1986 Huston, Jr.
4,615,253 A 10/1986 McGovern (Continued)

*Primary Examiner*—Lincoln Donovan
*Assistant Examiner*—Robert W. Horn
(74) *Attorney, Agent, or Firm*—L. Wayne White

(57) ABSTRACT

A modular automated assistive guitar is described comprising a base assembly, a pick assembly, a strumming mechanism and a fretting mechanism which, in combination with a standard guitar or similar stringed musical instrument (e.g., banjo, steel guitar, ukulele), forms a musical device that can be played by an individual with a range of independence, cognitive and physical abilities. The base assembly accepts, positions, and secures a standard guitar. The pick assembly includes quick attach and spring-loaded features for attaching and detaching picks, in addition to flexibility for smooth interaction with the guitar strings. The strumming mechanism provides cyclic motion and speed control to create pleasant and variable rhythm from the mounted guitar. The fretting mechanism allows a user to change chords and tone. An unmodified, traditional guitar is preferably used in the musical device. The guitar is easily interchangeable with another guitar or other stringed instrument, at the convenience of the user. The modular automated assistive musical device, with or without the guitar, is compact, light, portable, and easily adjustable to different individual's needs, motor skills, and dexterity.

1 Claim, 16 Drawing Sheets

U.S. PATENT DOCUMENTS 4,665,789 A * 5/1987 Papadatos ..... 84/317
5,056,397 A 10/1991 Leifheit
5,212,330 A * 5/1993 Cooper ..... 84/320
5,393,925 A 2/1995 Wilson
6,166,307 A 12/2000 Caulkins et al.
6,369,307 B1 4/2002 Wells
6,723,904 B1 * 4/2004 Dolan et al. ..... 84/267

* cited by examiner

MODULAR AUTOMATED ASSISTIVE GUITAR

BACKGROUND OF THE INVENTION

Music therapy developmentally facilitates individuals to share their knowledge of new skills with others. By learning how to play an instrument, such as an assistive guitar, an individual has the opportunity to develop a sense of industry and competence. Music serves multiple functions, including social, emotional, and compensatory needs and is multimodal, involving perceptual, cognitive, and physical processes. One goal of the device is to disclose an assistive musical instrument, referred to herein as a "modular automated assistive guitar," that can be actuated by an individual with a range of independence and physical abilities. The use of the modular automated assistive guitar may also be facilitated by another person, such as a teacher, therapist, or colleague. This person may also be restricted in his/her range of physical or cognitive skill level.

The legal system of the United States federal government and of various states support, and in some instances mandate, that all children within their jurisdiction have access to a free public education, emphasizing special education and related services for students with identified physical or metal disabilities. Many school systems in the United States, exemplified by Rosedale School, an Austin Independent School District campus for students with multiple disabilities in Austin, Tex., support the unique needs of their students and provide a positive learning environment to prepare them to live, work, and enjoy life in their community. These school systems are supported, in turn, by research and development work at colleges, universities and commercial industry. The curriculum offered by the Mechanical Engineering Department and research efforts conducted under the direction of Dr. Kristin L. Wood is cited as examples of such support at the University of Texas at Austin. The musical device of the present invention can be effectively used by the school systems to assist students within their systems that have such special needs.

Beyond the use in music therapy and as assistive devices for the classroom, automated instruments provide an avenue for teaching basic instrument lessons and for appreciating the musical sounds produced by the instrument. In the case of the present modular automated assistive guitar, a modular architecture is disclosed which include a base assembly, a pick assembly, a strumming mechanism and a fretting mechanism as novel, distinct subsystems. These modules provide permit the user to focus on particular actions of playing the guitar while automating other actions. For example, strumming with a particular rhythm or cadence may be actuated within the modular guitar system while the operator slides the fretting mechanism to learn or play different chords. The operator(s) may also change picks, adjust strumming speeds, or change particular guitars within the device. The modular automated assistive guitar is usually positioned on a stand (a separate unit) that permits the operator to adjust the guitar in height and orientation for convenience.

Several United States Patents (USP) have been issued that relate to stringed musical instruments (e.g., the guitar) and modifications to the traditional instruments. The following patents are illustrative: U.S. Pat. No. 4,024,787, U.S. Pat. No. 4,030,400, U.S. Pat. No. 4,331,059, U.S. Pat. No. 4,428,273, U.S. Pat. No. 4,566,365, U.S. Pat. No. 4,615,253, U.S. Pat. No. 5,056,397, U.S. Pat. No. 5,212,330, U.S. Pat. No. 5,393,925, U.S. Pat. No. 6,166,307, U.S. Pat. No. 6,369,307 and U.S. Pat. No. 6,723,904. So far as the inventors are aware, none of the devices described in these patents have been used in whole or in part as an automated assistive guitar. Accordingly, there is a long-felt need for such a musical device to assist persons with physical, emotional, or mental needs.

The first objective of the present invention is to provide a modular automated assistive guitar that will interface with a conventional/standard guitar and automate the actions of flexibly holding a pick, strumming with different cadence or rhythm, and guiding a fretting device for choosing the chords and tonal quality of the produced music. For convenience, as used herein, the term "guitar" shall mean a guitar and other similar stringed musical instruments (e.g., a banjo, steel guitar, ukulele) that have a body and a neck, similar to a guitar, and are played in substantially the same way as a guitar. The second objective of this invention is to provide a modular automated assistive guitar that is easily adaptable to various guitars. The third objective is to provide an assistive musical instrument that is compact, light weight, and portable (an instrument that is relatively easily transported by the operator). The fourth objective of this invention is to provide a system that is easily positioned to accommodate the operator's height, weight, and preferred means of interaction with the instrument, based on the operator's physical abilities. In some instances, the operator may be able to stand but in other instances the operator may be restricted to a sitting position (as in a wheelchair) or to a reclining position (as on a hospital type bed or couch). The operator may also be limited in how he or she can activate the switch mechanism of the automated assistive guitar. In some instances, the operator may have the physical ability to activate it with their limbs, but in other instances the physical ability of the operator may be restricted to the use of other parts of their body (e.g., head, torso, etc.) to activate the switch mechanism. A modular automated assistive guitar has now been discovered that meets the above objectives.

SUMMARY OF THE INVENTION

A novel modular automated assistive guitar is disclosed which utilizes four novel subsystems/modules (i.e., a base assembly, a pick assembly, a strumming mechanism and a fretting mechanism) in combination with a guitar to form a novel automated musical device that can be played by an individual with a range of mental and physical abilities. Optionally an assistive guitar stand is used as another module to position the automated assistive guitar for convenient interaction by the operator(s). An unmodified, traditional (or standard) guitar is preferably used in the automated musical device but other similar stringed instruments may be used instead. Some individuals may prefer one type of guitar over another, and other individuals may prefer to use a banjo, ukuleles, or other stringed instrument. The guitar component is easily interchangeable in the automated assistive guitar for the convenience of the user.

Further objectives, goals, and advantages of this invention are apparent from the following description of a preferred embodiment. The accompanying drawings illustrate, schematically, the preferred embodiment.

DETAILED DESCRIPTION OF THE PREFERRED EMBODIMENTS

Figure 1:
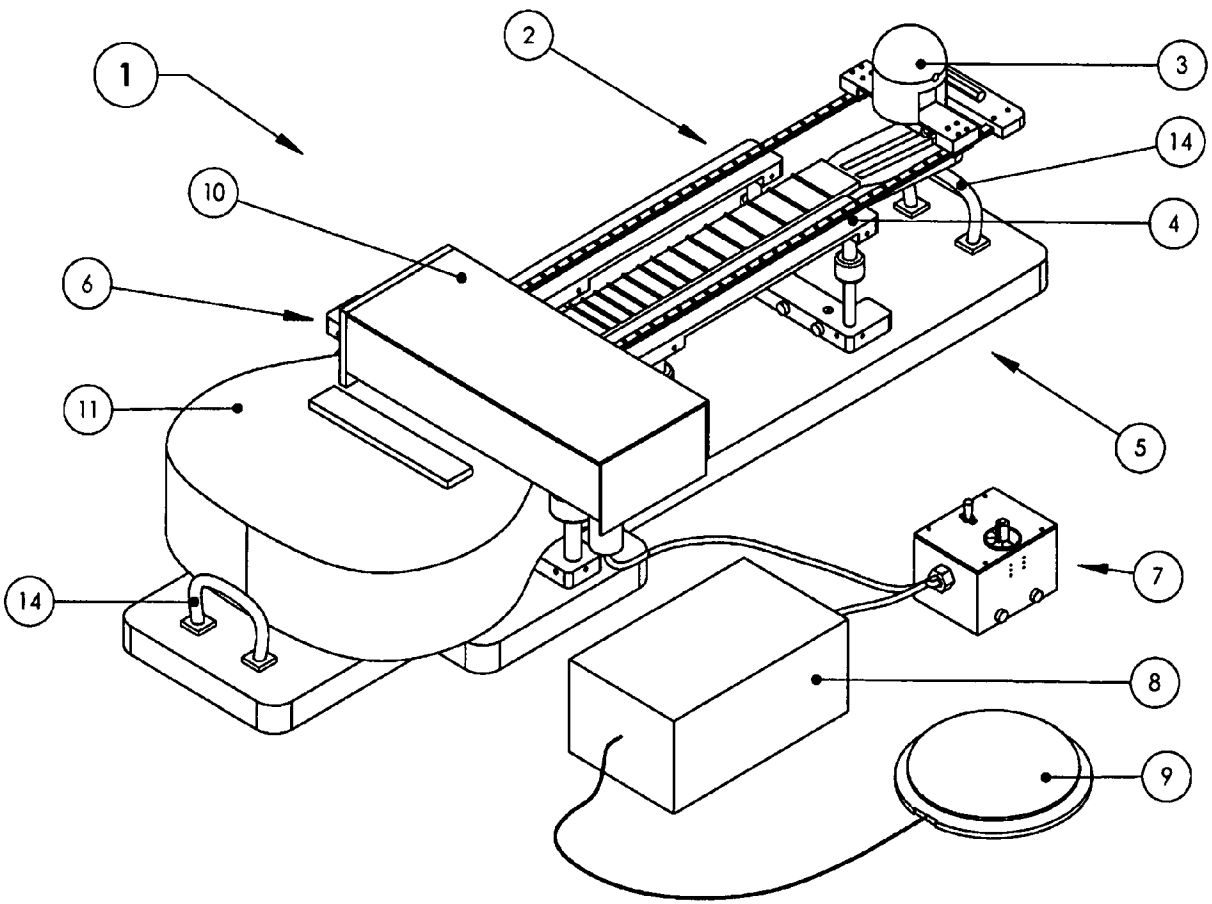
FIG. 1 shows the fully assembled modular automated assistive guitar as an isometric.
Figure 2:
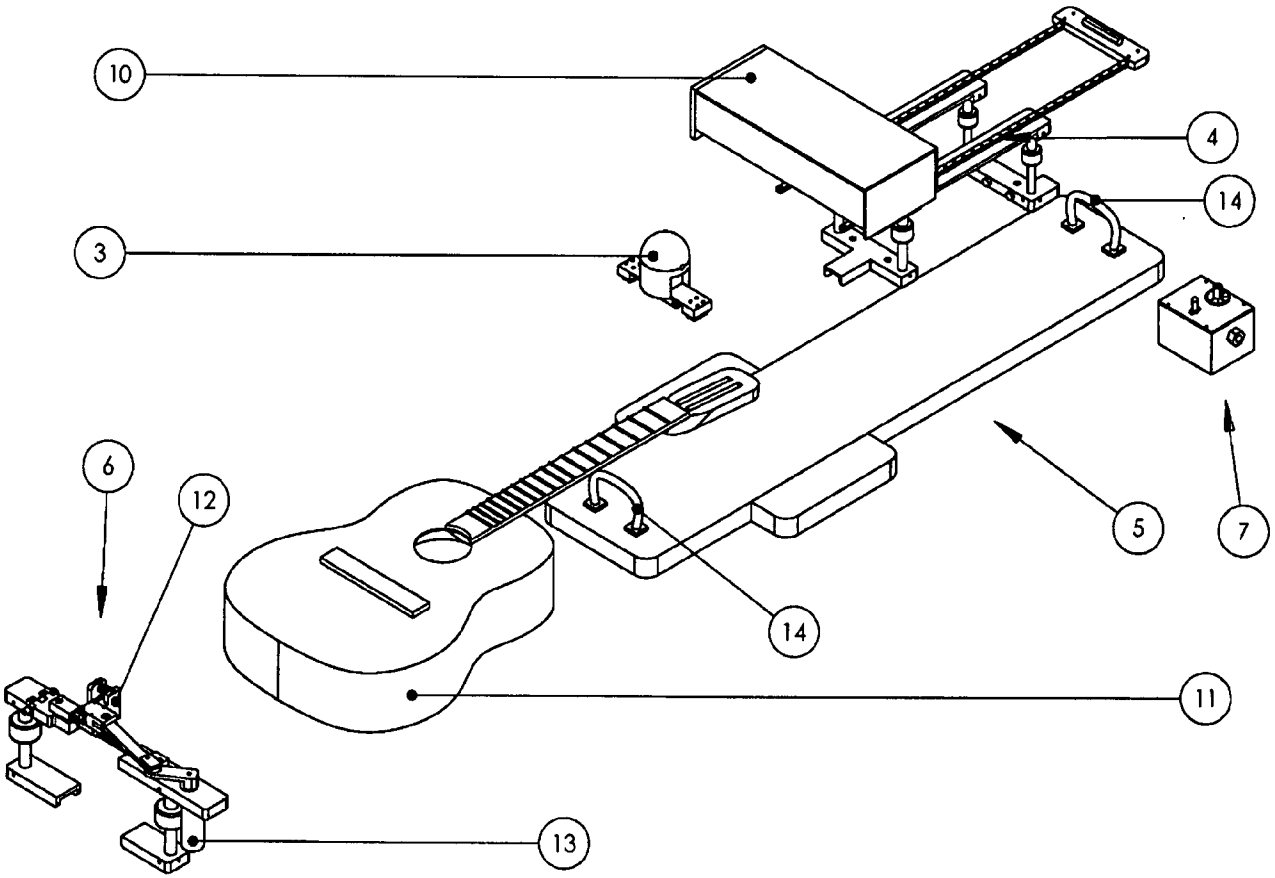
FIG. 2 shows an exploded view of the modular automated assistive guitar, including the base, pick, fretting, and strumming assemblies.
Figure 15:
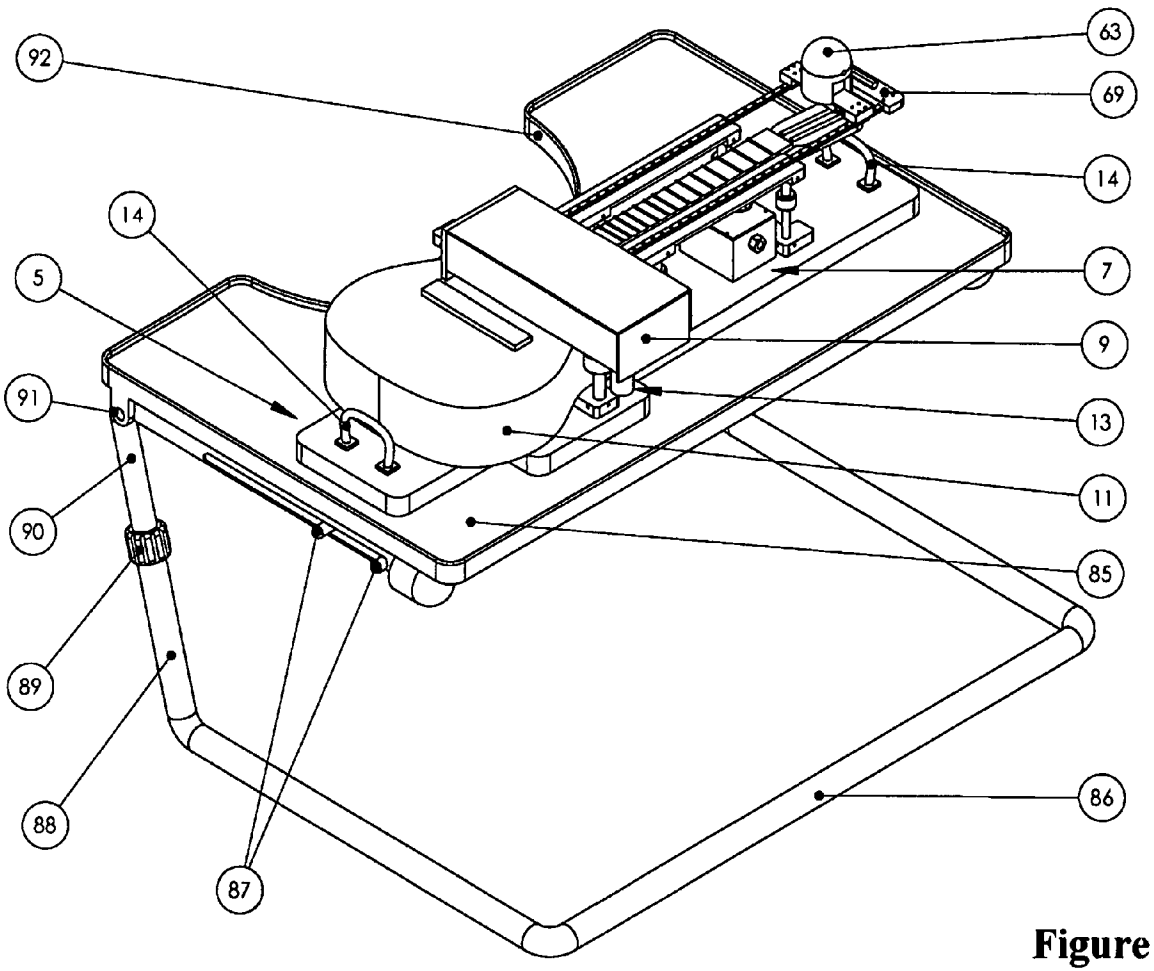
FIG. 15 shows the automated assistive guitar positioned on a modular guitar stand.
Figure 16:
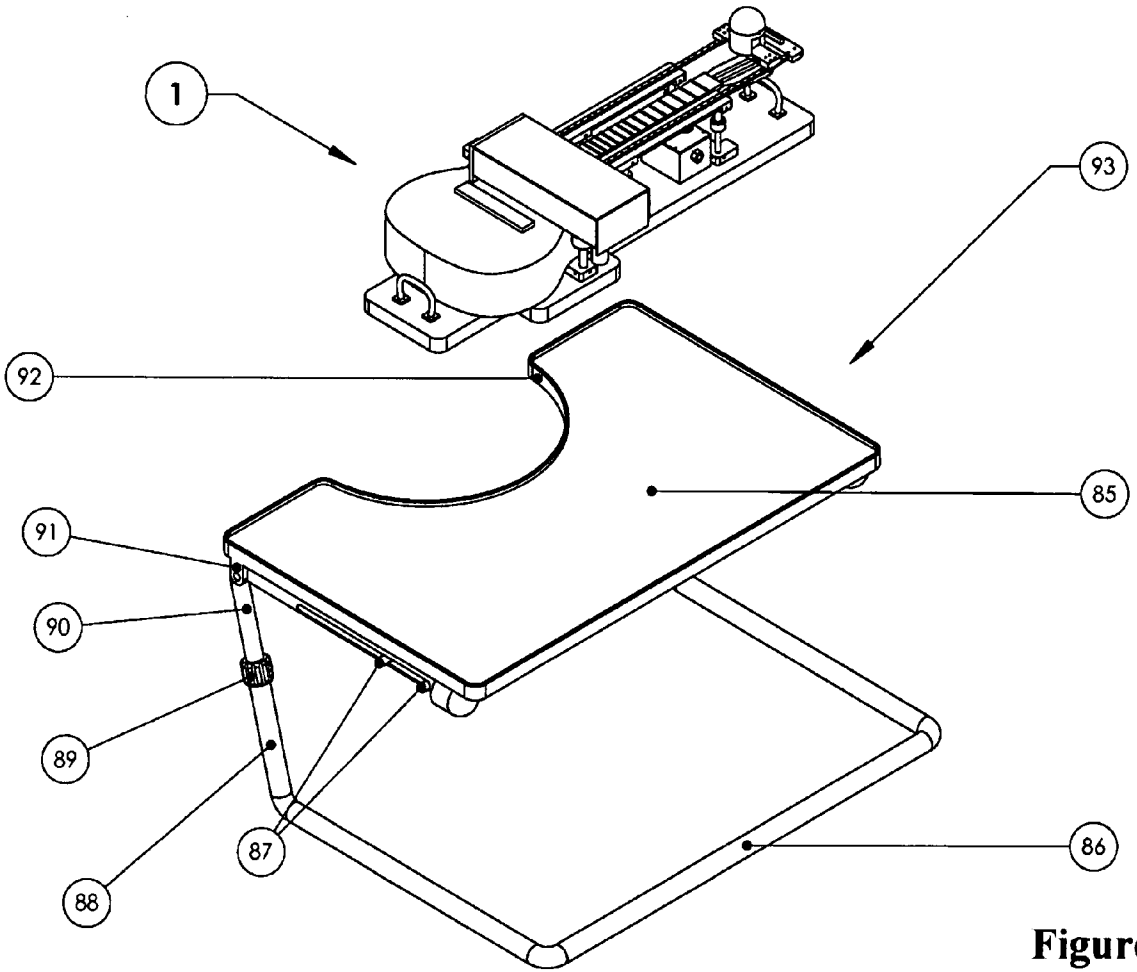
FIG. 16 illustrates the guitar stand as an exploded view, with the assembled automated assistive guitar shown in one position relative to the stand.

A presently preferred embodiment of the invention is described below with reference to the attached drawings. A modular automated assistive guitar 1 of the present invention including the four novel subsystems/modules and a standard guitar is shown in FIG. 1. An exploded view of the automated assistive guitar 1 is shown in FIG. 2. The musical device illustrated in FIGS. 1 and 2 is adapted to sit securely on a table or other flat surface (referred to herein as a guitar stand). The guitar stand is shown in FIGS. 15 and 16 as an optional module of the invention. FIG. 1 shows a conventional/standard guitar 11 that is positioned on the base 5 between the two opposing, top mounted handles 14. The fretting mechanism 2, composed of the fretting clamp 4 and fretting slider 3, is positioned over the neck of the guitar and is attached to the base 5 through the fretting clamp 4. The strumming mechanism 6 is positioned over the "waist" of the guitar and attached to base 5. The cover 10 (also referred to as a "safety shield") is positioned over the strumming mechanism 6 and is attached to the base 5. The pick assembly 12 is the fourth primary subsystem. The pick assembly 12 is contained within the strumming mechanism 6 and is illustrated in FIGS. 5, 6, 8, and 9. The cover 10 is optional, but preferred since it provides some level of protection to the strumming mechanism and the user. Thus, the cover helps improve the durability of the strumming mechanism and helps protect the user/operator from the many moving parts that are in motion during conditions of use. The cover 10 is preferably constructed from a transparent material, e.g., a transparent polycarbonate or Plexiglas®, to permit the user to view the strumming action of the pick across the strings of the guitar. The speed of the strumming is governed by a strumming controller 7, which is connected by electrical means (e.g., shielded and strain-protected wires) to the strumming mechanism. The strumming controller 7 includes an actuator (on/off) switch 33, shown in FIG. 5, and an optional secondary corded actuator (on/off) switch 9. The modular musical device 1 can be actuated by the electrical switching device 33 (and optionally with 9) to power the motor 13 and create motion in the strumming mechanism and pick attachment. The fretting mechanism 2 is operated manually and may be manipulated in conjunction with the controller 7 to produce and compose guitar music on the musical device. This operation may be carried out either by the user or by another person (e.g., a teacher, a facilitator, or another student) depending on the physical and/or cognitive abilities of the user.

Figures 3A, 3B:
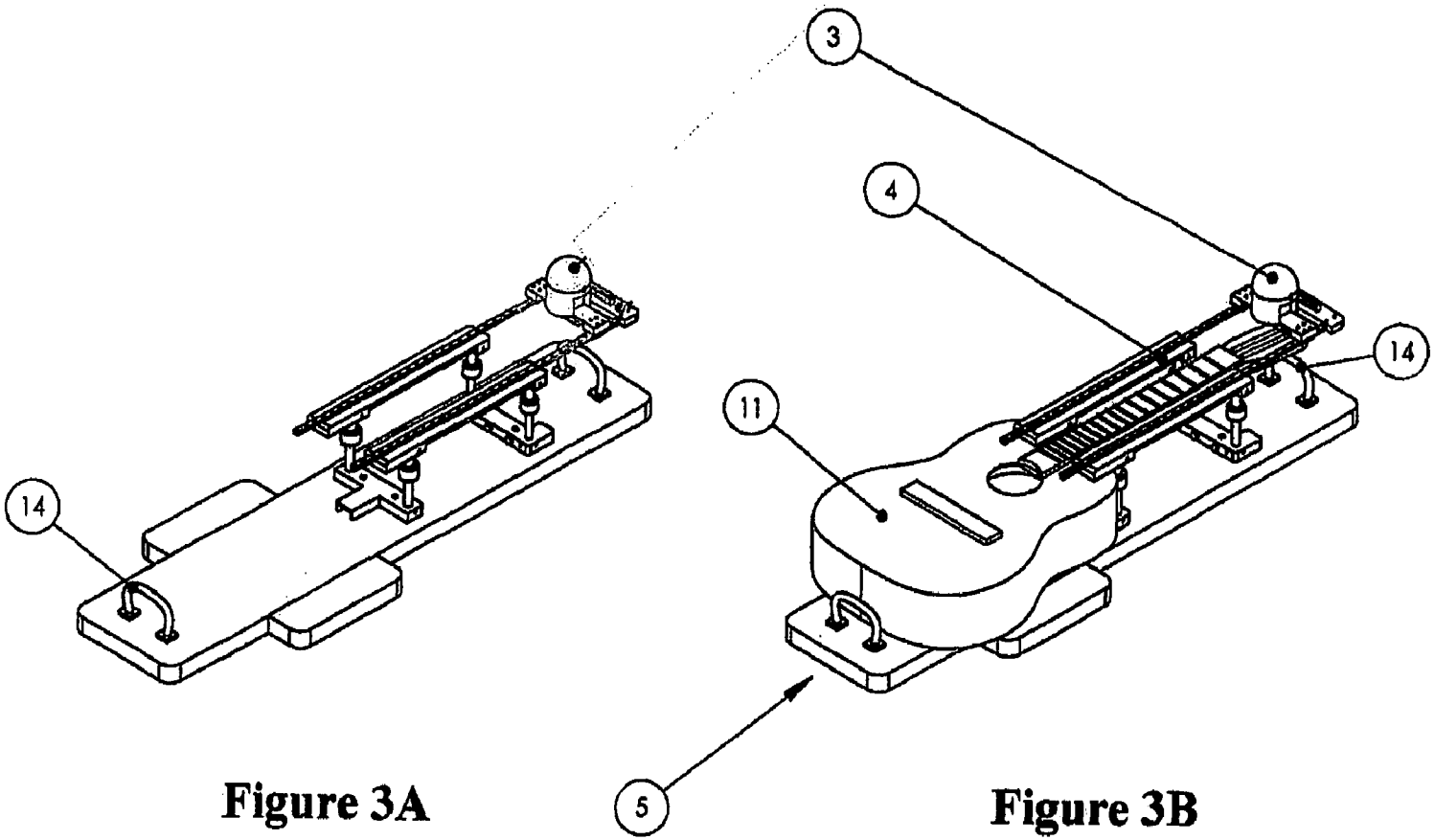
FIG. 3A illustrates a perspective view of the base assembly and FIG. 3B illustrates an assembled view of the base assembly and guitar as an isometric.
Figure 4:
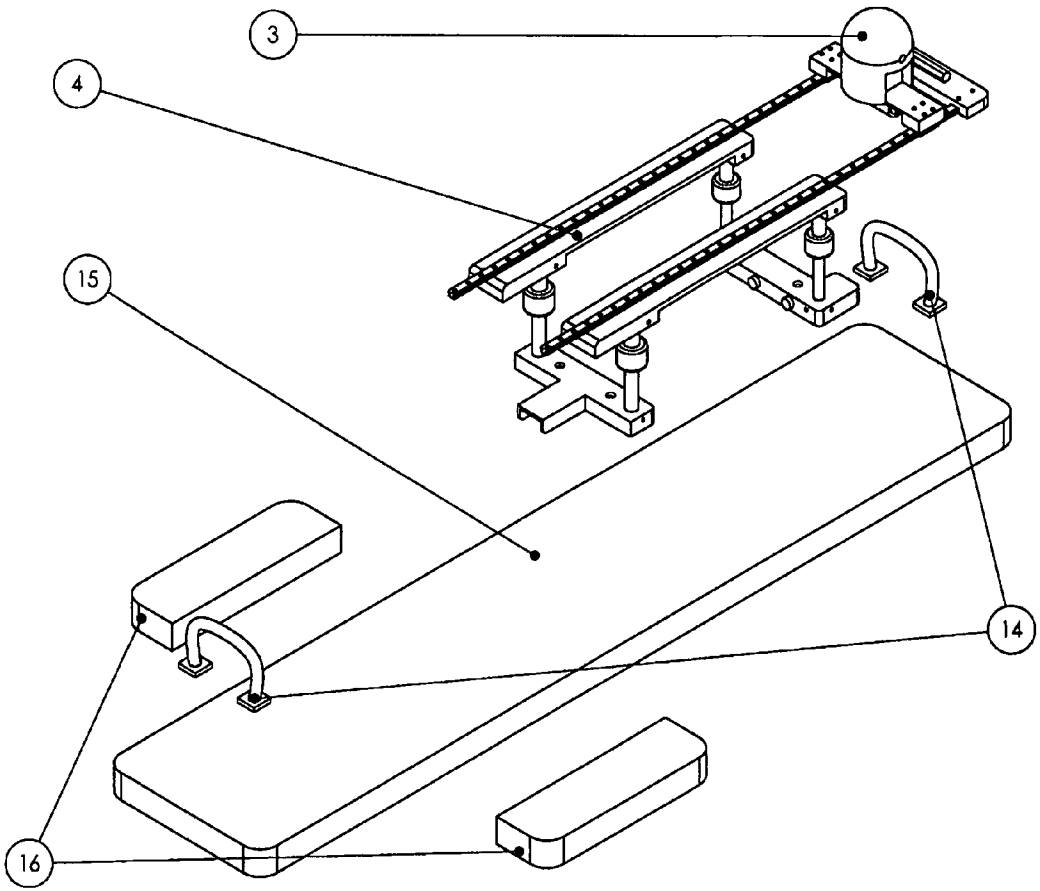
FIG. 4 shows an exploded view of the base assembly from FIG. 3 without the guitar.

Considering FIGS. 3 and 4, a base assembly 5 is illustrated both with and without a guitar. This base assembly 5 includes a wooden base board that is appropriately sized and shaped 15, two wooden frame wings 16, two lifting handles 14, and the fretting mechanism 2. The fretting mechanism 2 is held to the wooden base board 15 by means of a plurality of fasteners which provides the system with increased stability during use. The lifting handles 14 provide an easy means of lifting and carrying the modular musical device 1 thus increasing its portability.

Figure 5:
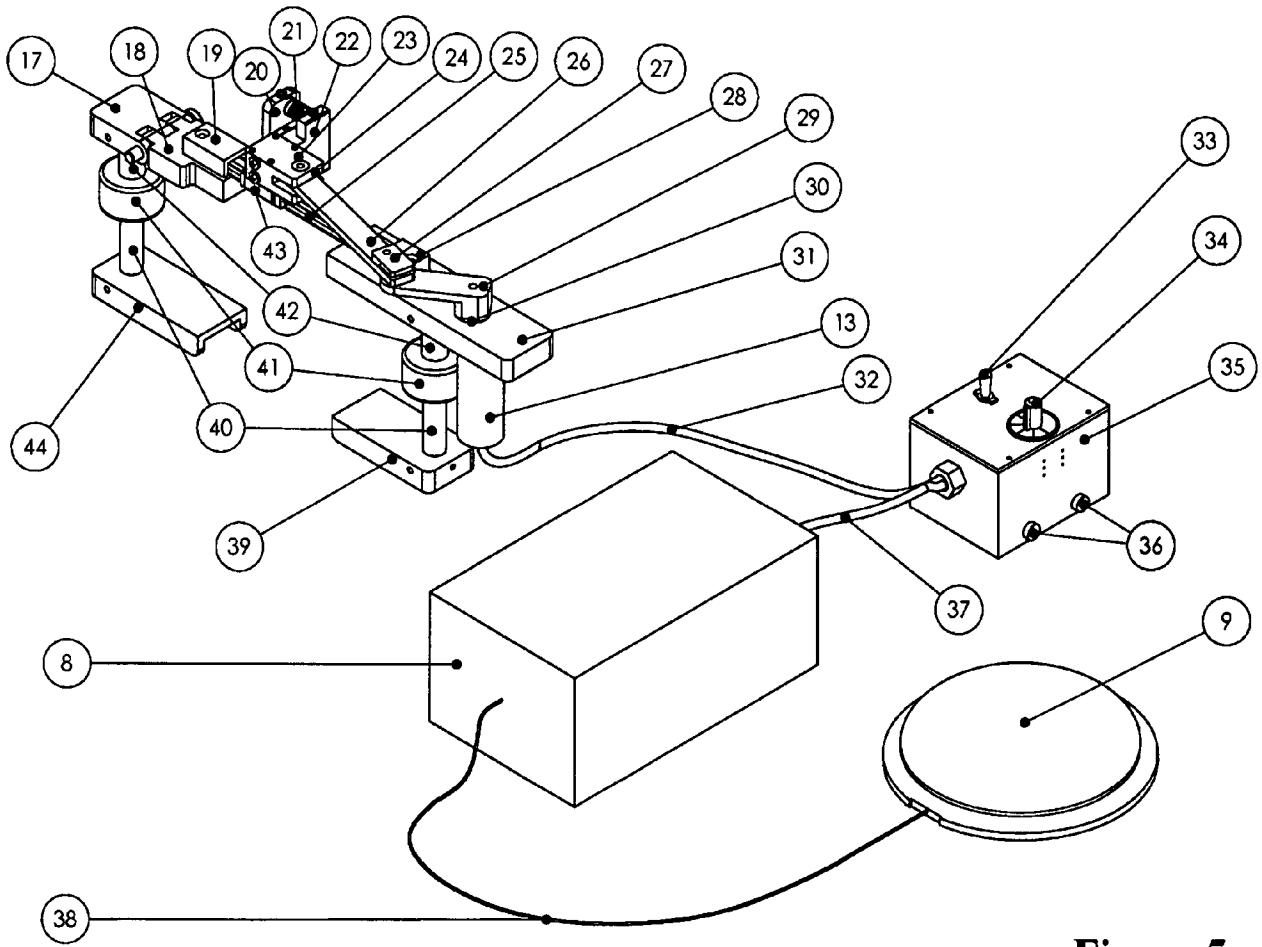
FIG. 5 shows an isometric of the strumming mechanism, including the strumming controller.
Figure 6:
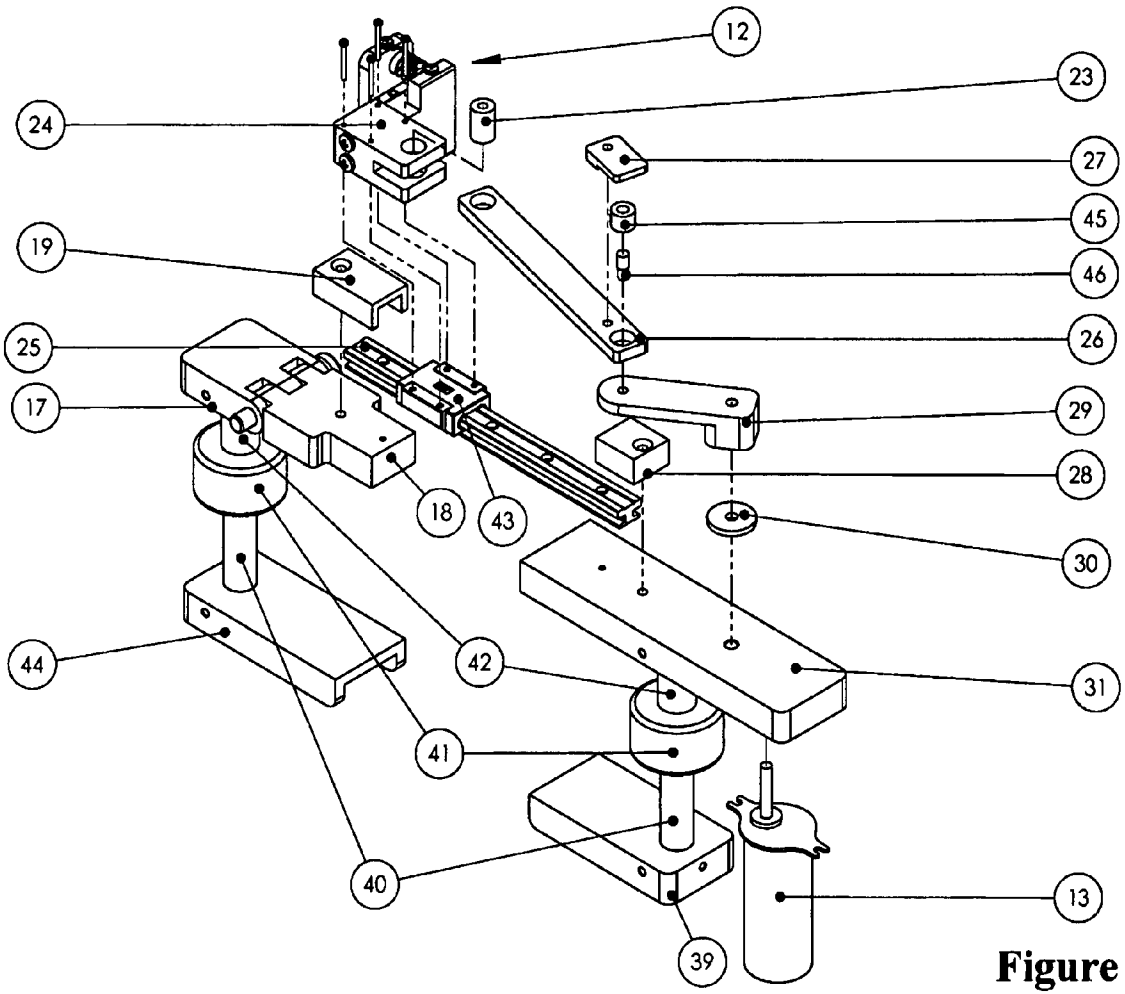
FIG. 6 shows the strumming mechanism, exploded view.

FIG. 5 shows an embodiment of the strumming mechanism 6, and FIG. 6 shows an exploded view of this module. The strumming mechanism 6 consists of a moving slider 43 (also referred to as a strumming bearing), connected to the pick attachment 12 (FIGS. 8 and 9) that is slidably mounted on and runs the length of a linear guide 25 (also referred to as a strumming guide). The moving slider 43 and pick attachment 12 are jointly and rotatably connected to a connecting rod 26, which in turn is rotatably connected to a crank 29 and a motor side guide clamp 28 via a crank pin 46, a crank bushing 45, and a bushing cap 27. The crank 29 is also fixedly connected to the shaft of motor 13, which is passed through a hole in motor mount arm 31. Motor mount arm 31 is mounted on the large female telescoping leg 42 that can be adjusted in height via use of a large circular clamp 41. The large male telescoping leg 40 is fixedly attached to a motor side foot 39. The strumming guide 25 is fixedly attached at one end to the top side of motor mount arm 31 and is fixedly attached at the other end to the top side of inner hinge arm 18. The ends of strumming guide 25 are covered by the motor side guide clamp 28 and the hinge side guide clamp 19, which are fixedly attached to the motor mount arm 31 and inner hinge arm 18 respectively. These structures serve to further stabilize the strumming guide 25 and to limit the range of motion of the strumming bearing 43 and pick attachment 12. The inner hinge arm 18 is rotatably attached to an outer hinge arm 17. The outer hinge arm 17 is attached to the large female telescoping leg 42 that can be adjusted in height via use of a large circular clamp 41. The large male telescoping leg 40 is attached to a hinge side foot 44. The motor 13 is connected electrically 32 to the strumming controller 35, which in turn is electrically connected 37 to a power supply 8. This permits the shaft of the motor 13 to be quickly rotated at different speeds at the option or discretion of the operator. When activated, the shaft of the motor causes the crank 29 to rotate, which in turn causes the pick assembly 12 mounted to the strumming bearing 43 to reciprocate along the length of the strumming guide 25. This movement causes the pick 61 (FIGS. 8A and 8B) in the pick assembly 12 to reciprocate perpendicularly across the strings of the guitar 11 mounted below the motor mount arm 31 and the inner hinge arm 18. This strumming mechanism 6 works efficiently and has substantial advantages, such as modularity, that facilitate manufacturing and assembly. The ability to use readily available components, such as an AC or DC motor 13, also provides cost advantages to the manufacturer of the automated assistive guitar.

Figure 7:
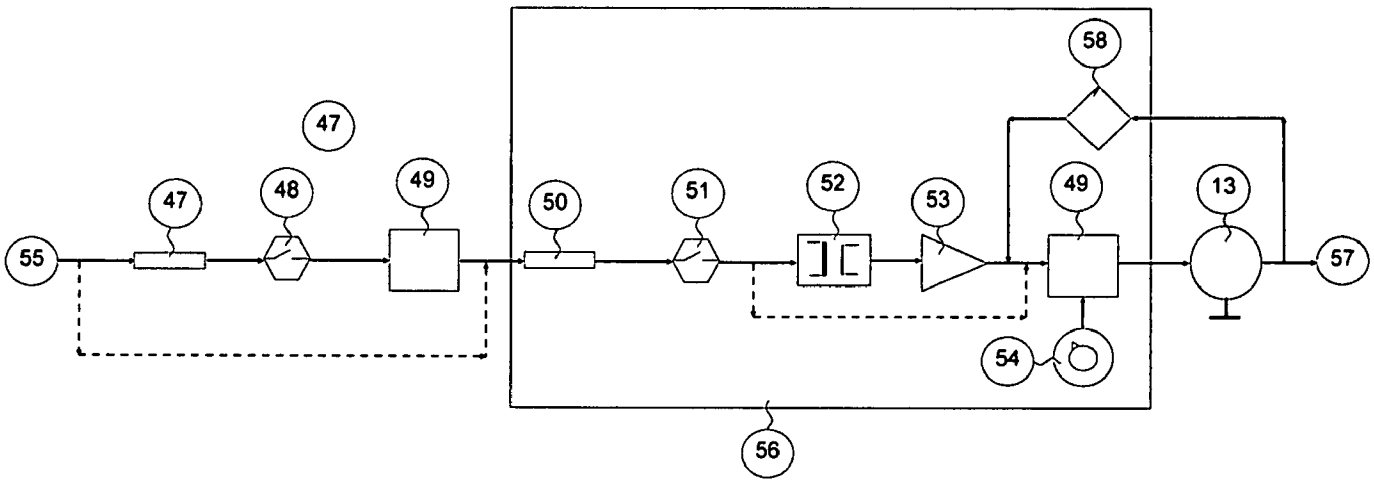
FIG. 7 shows the strumming mechanism controller as a block diagram.
Figures 8A, 8B:
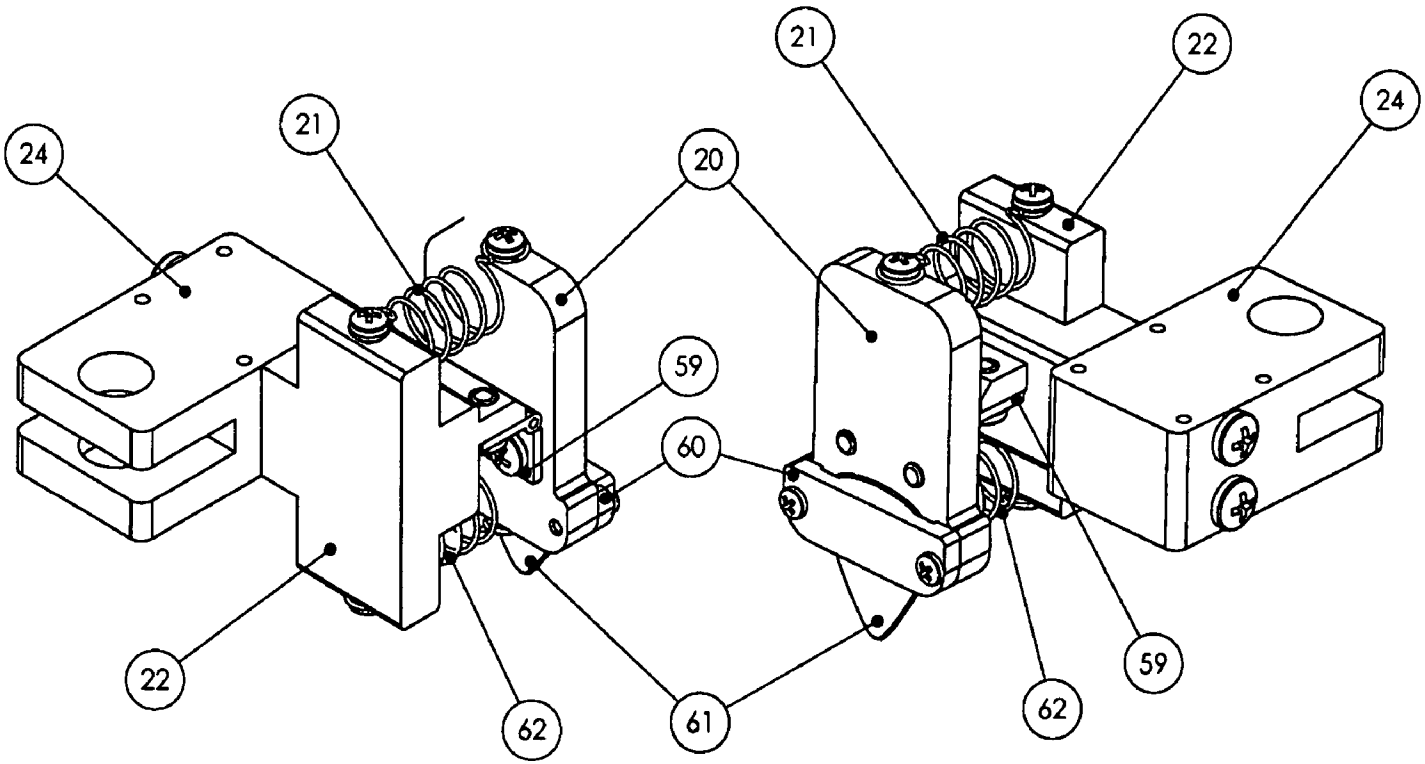
FIG. 8 shows the pick attachment assembly as an isometric from two directions of view (FIGS. 8A and 8B).

FIG. 7 shows different embodiments of the means to control the motor 13, mounted to the strumming mechanism 6, according to the invention. The controller 7, which has the circuit embodiment 56, is connected to the AC/DC power supply 55 and actuated via a remote secondary actuator 49 with a primary actuator 51, preceded by line breakers 48 and 50 respectively, where the remote secondary actuator 49 actuates a regulator 49 for timed power supply to the circuit of the controller 56. Alternatively a different circuit embodiment can be to connect the power supply 56 to the primary actuator 51 proceeded by a line breaker 50 (dotted). Depending upon AC/DC power supply 55 two alternate controller 56 circuits can be embodied after the primary actuator 51, one utilizing AC supply requiring the use of a transformer 52 and rectifier 53 further electrically connected to a regulator 49, or the other circuit embodiment can be an electrical connection between the primary actuator 51 and the regulator 49 (dotted). A manual selector 54 is used with the regulator 49 to regulate power supply to the motor 13 that outputs rotation 57. Optional feedback sensory device 58 can be embodied (dotted) to improve user control over the motor 13 output.

Figure 9:
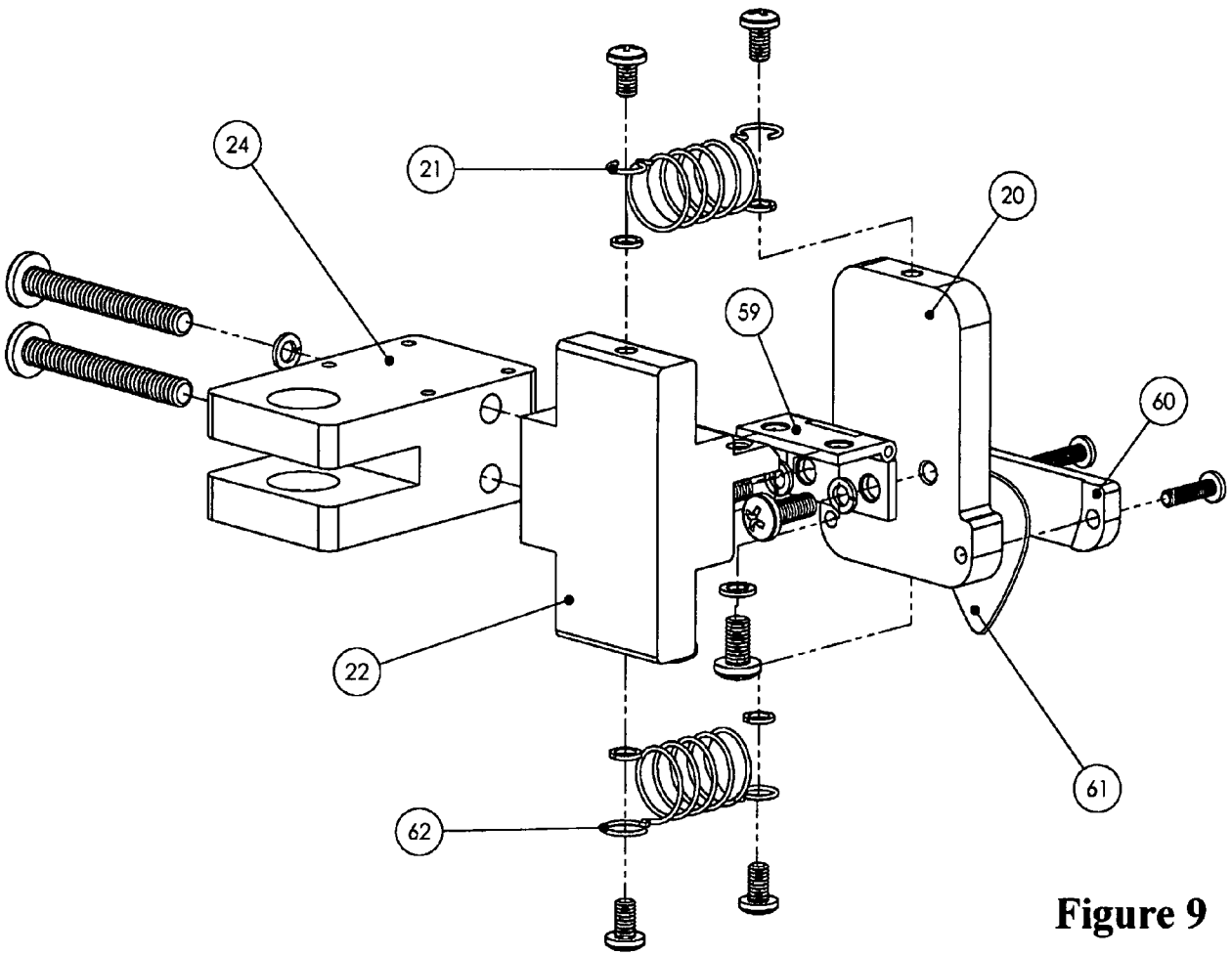
FIG. 9 illustrates the pick attachment as an exploded view.

The picking mechanism 12 (also referred to as a "pick attachment") is shown in FIGS. 8 and 9. The springs 21 and 62 shown in FIGS. 8 and 9 provide suitable compliance (flexibility) for strumming the guitar 11, thus producing an enjoyable musical sound. A discovery made during the design of the pick assembly was that it needed to have compliance for strumming the guitar strings in both directions as the pick attachment 12 travels reciprocally along the linear guide 25. Two springs (21 and 62), or equivalent, are, therefore, incorporated into the design of the pick attachment to permit one spring to hold the pick in resilient contact with the strings of the guitar as it moves in one direction, and a second spring to hold the pick in resilient contact with the strings of the guitar in the reverse direction. Two extension springs (21 and 62) provide this compliant arrangement and connect the pick mount 20 to the pick mount base 22, one attached at the top and one at the bottom for compliance in both strumming directions. The pick 61 is held between the pick mount 20 and the pick clamp 60 by pressure asserted by threaded fasteners (e.g., screws) or equivalent, drawing the pick clamp 60 against the pick mount 20. Other means to secure the pick 61 to the picking assembly 12 could be used, if desired. The pick mount base 20 is then fixedly attached to the piston 24. Piston 24 is a C-shaped component that has an aperture (e.g., circular hole) fabricated through both "arms" of the C-shaped structure; this arrangement permits a bushing to be inserted through the aperture (e.g., open hole) and through a matching aperture (e.g., hole) in one end of the connecting rod 26 that is positioned between the arms of the piston 24, thereby allowing it to be rotatably mounted to one end of the connecting rod 26.

Figure 10:
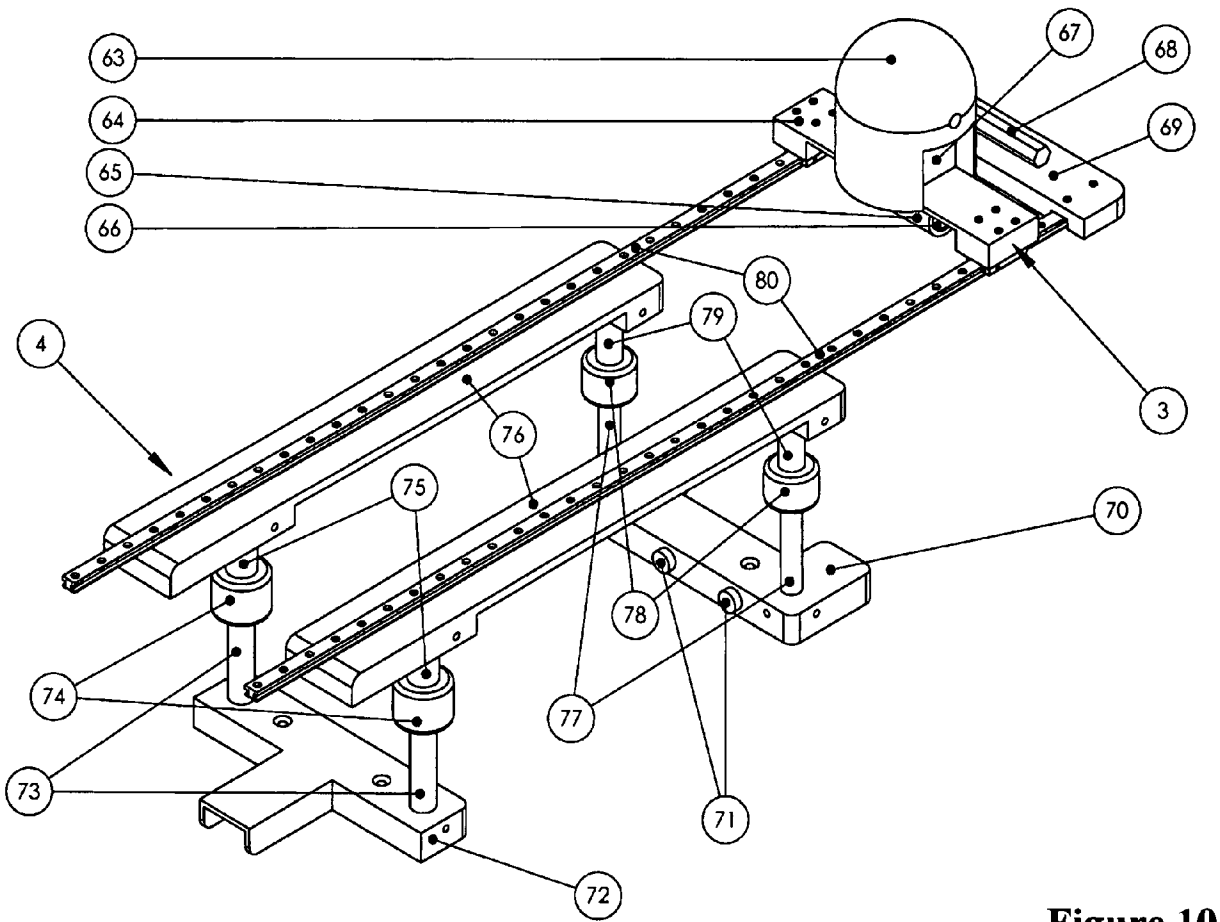
FIG. 10 shows the fretting mechanism as an isometric.
Figure 14:
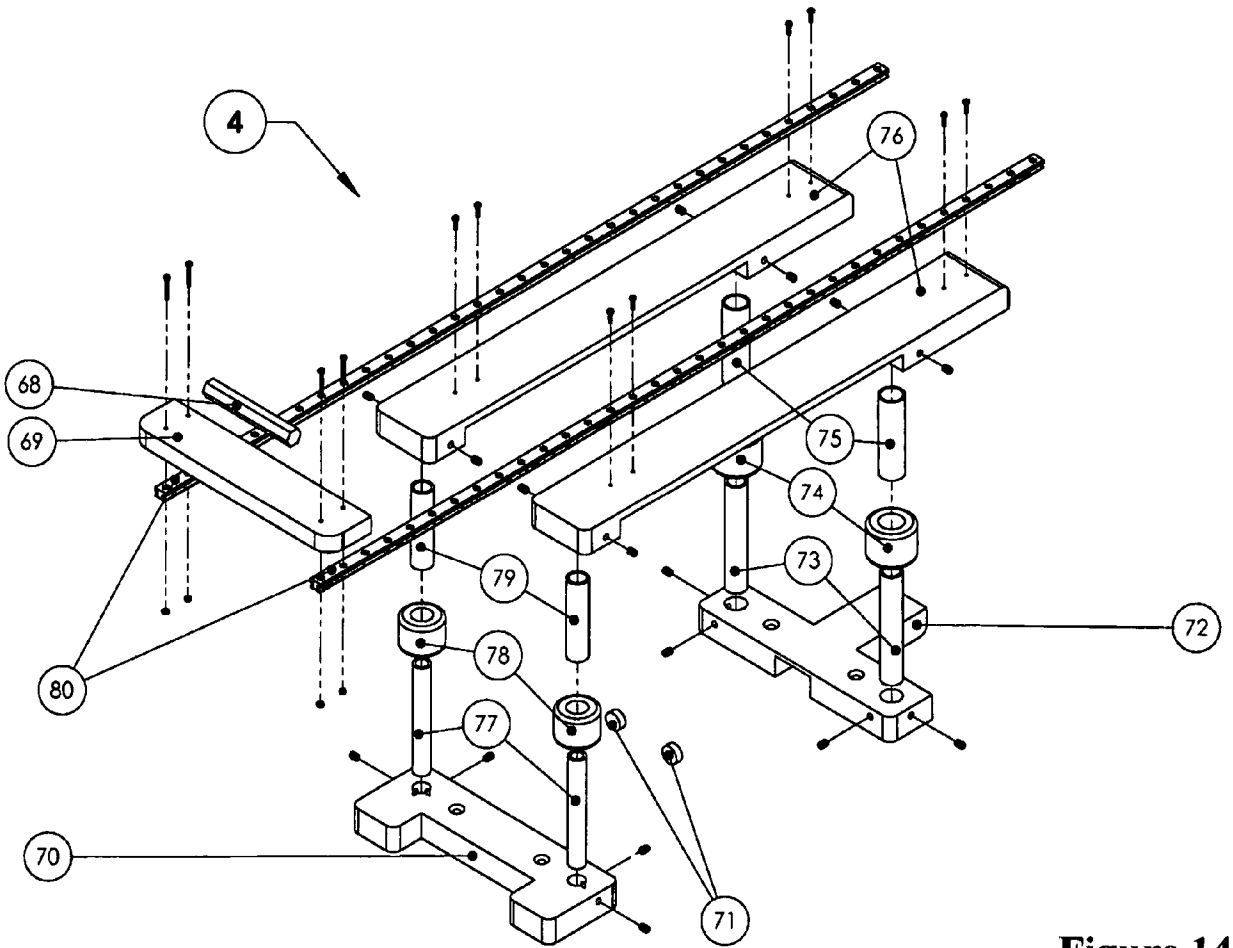
FIG. 14 shows the fretting clamp, support, and translational slinging subsystem of the fretting mechanism as an exploded view.

With reference to FIGS. 10 and 14, 4 generally designates a clamping device (also referred to as a "fretting clamp" and "fretting support") for holding the guitar 11 in place while the fretting mechanism 2 is being operated. The fretting clamp 4 is composed of two parallel linear guides 80 (also referred to as "fretting guides"), which in turn are each fixedly attached to two parallel arms 76. Each of the two arms 76 are fixedly attached to the body side foot 72 via the adjustable telescoping legs (73, 74 and 75). The other ends of the two arms 76 are fixedly attached to the neck side foot 70 via the adjustable telescoping legs (77, 78 and 79). Items 73, 75, 77 and 79 are leg segments and items 74 and 78 are circular clamps, respectively, which permit the individual legs to telescope to appropriate lengths so that the arms 76 can be raised to allow the guitar 11 (FIG. 2) to be appropriately positioned and the lowered to hold it in place. An end piece 69 is mounted at the extreme end to each of the linear guides 80 to provide an end stop for the slider assembly 3. Channels are preferably routed into each end of the end piece 69 to match the fretting guides 80; this structure permits the end piece 69 to slide down and over the fretting guides 80 and form a more secure end stop. While various means can be used to fixedly attach the end piece 69 to the fretting guides 80, it is convenient to use threaded fasteners that can be inserted through clearance holes fabricated at either end of the end piece 69 and those present along the length of the fretting guide 80. A spirit level 68 is preferably attached to the top side of the end piece 69 to aid the operator in leveling the fretting mechanism 2 on the base 5 (FIGS. 1 and 2).

Figure 11:
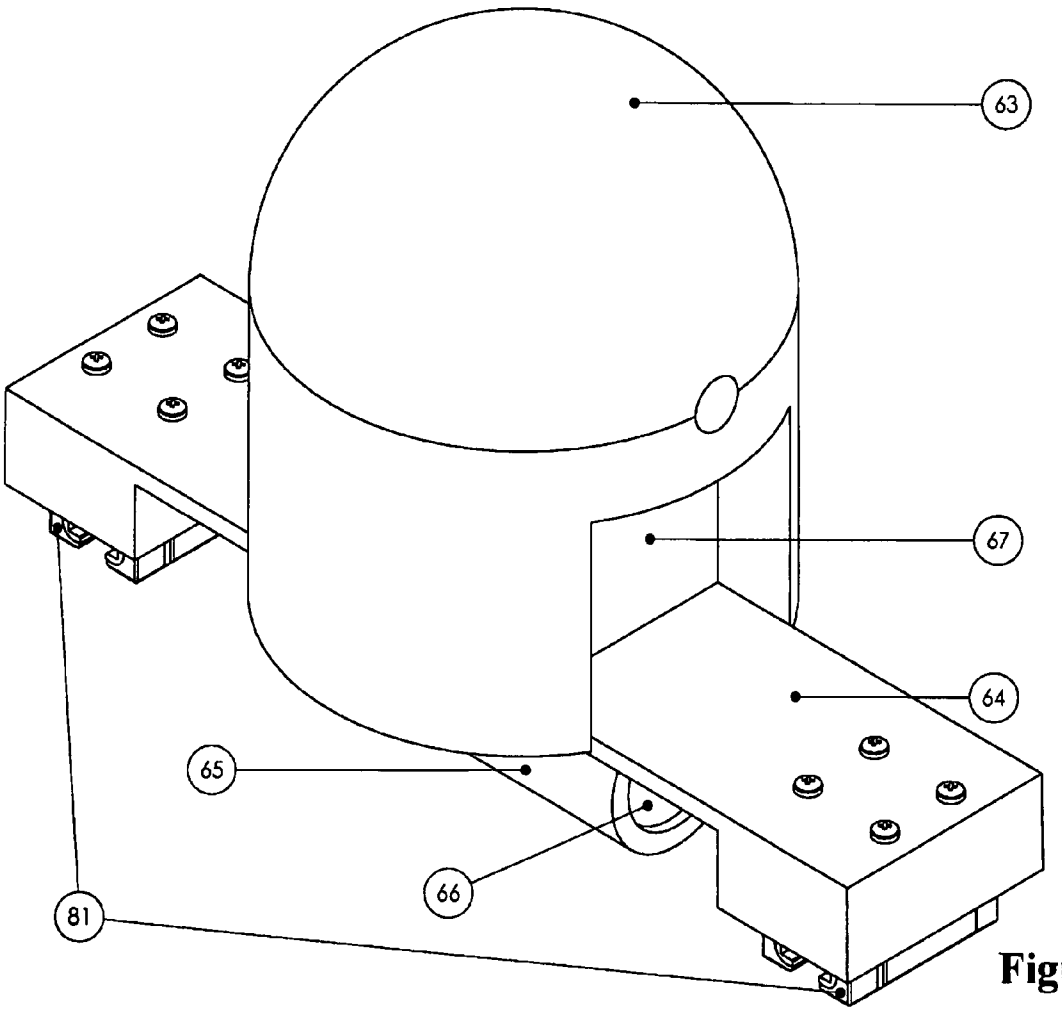
FIG. 11 shows the fretting slider subsystem of the fretting mechanism. The figure is an isometric.
Figure 12:
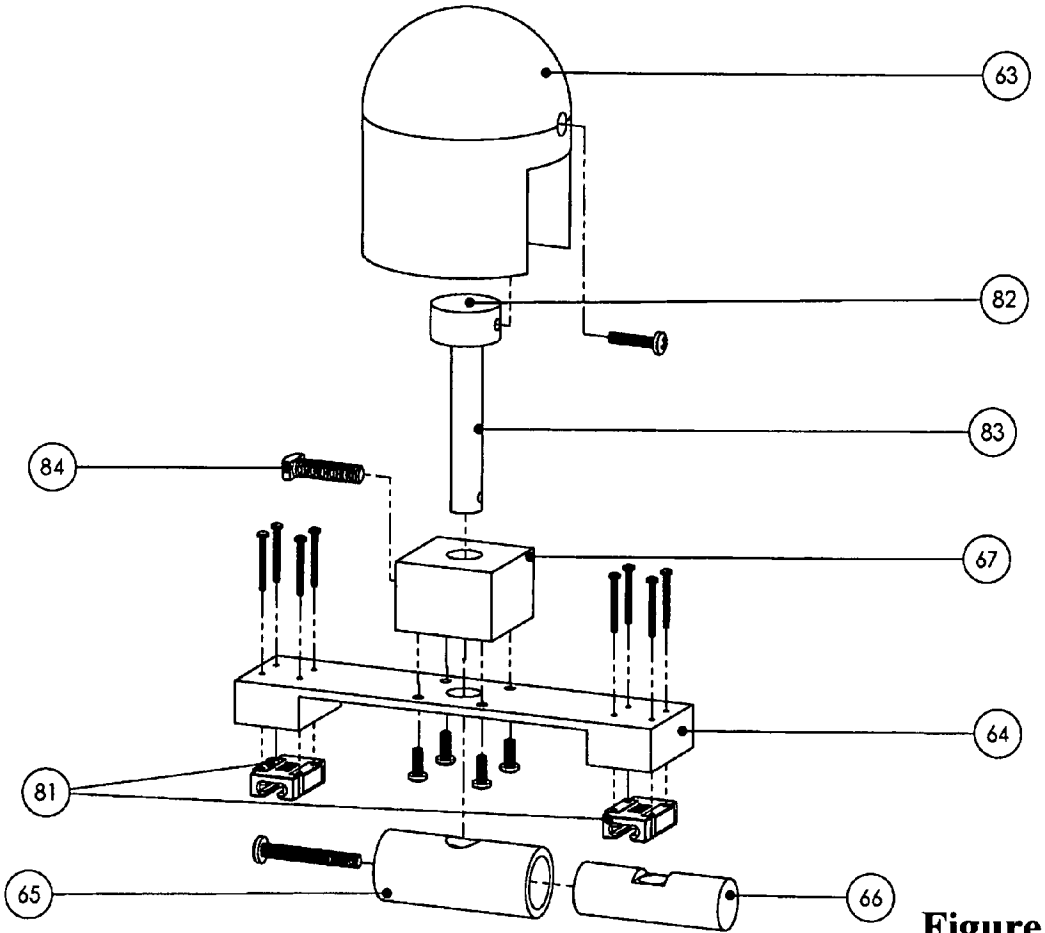
FIG. 12 shows the fretting slider subsystem as an exploded view.
Figure 13:
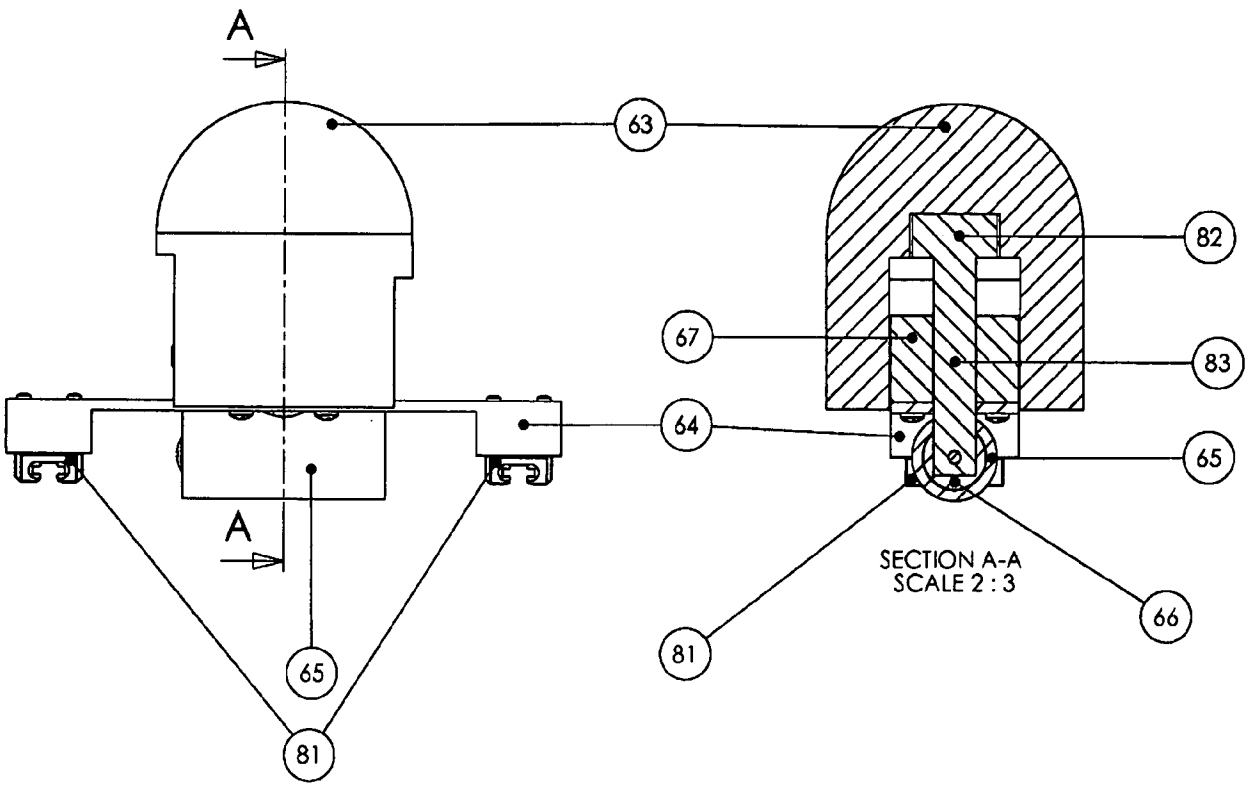
FIG. 13 shows the handle (human interface) for the fretting mechanism and a cross-section thereof.

The fretting slider 3 is illustrated in FIGS. 11 through 13. This module 3 fretting mechanism 2 depicted in FIG. 11 is shown in exploded view in FIG. 12, and in cross-section in FIG. 13. The slider base plate 64 is fixedly attached to two fretting bearings 81 which, in turn, are slidably mounted on the two fretting guides 80 of the fretting clamp 4 (FIGS. 10 and 14) on either side of the neck of the guitar 11. The handle 63 is mounted onto plunger 83 via a collar 82 (also referred to as the "plunger head") with a set screw or equivalent attachment means. The plunger 83 slides through a matching hole fabricated in the plunger guide 67 and the slider base 64 and a matching hole in the slide aligner 66 to hold the slide 65 in place. The slide 65 traverses the neck and is in contact with the strings of the guitar. The operator can cause the slide 65 to exert different pressure on the strings of the guitar 11 by how hard he/she presses the handle 63 down against the strings of the guitar 11 and can lock it in place with a thumb screw 84 when the desired pressure in achieved. The generally rectangular openings in the handle 63 permit the handle 63 to slide down over the plunger guide 67 when the handle 63 is pushed down during fretting operations. Once this operation is completed, the operator can use the handle 63 to move the fretting slider 3 to different fretting positions along the neck of the guitar 11 by moving it along the length of the fretting guides 80 thus enabling him/her to play a number of different chords. The design of the fretting mechanism 2 satisfactorily addressed a number of technical issues, including quality of the musical sounds produced, ease of use, and overall stability.

Considering FIGS. 15 and 16, an optional guitar stand module 93 is illustrated. This guitar stand 93 includes a flat table top surface 85, which includes an entrance cavity or indentation 92 to increase the proximity of the user to the modular musical device 1. The table top 85 is rotatably connected to a support structure via hinge joint 91 and can be adjusted to various angular orientations through the use of a sliding support 87. The height of the table top 85, at any given orientation, may be adjusted through the use of telescoping leg structure (88, 89, and 90) where 88 and 90 are female and male leg segments respectively connected by a circular clamp 89. A horizontal bar member 86 adds additional stability to the guitar stand assembly 93.

Besides the four primary subsystems (and optional guitar stand), the assistive guitar design preferably includes protective padding, e.g. closed-cell foam rubber, on all of the surfaces that interface with and contact the guitar. Such padding helps avoid surface marring and tonal distortion.

Various safety devices can be added to the present musical device. The transparent plastic cover 10 (FIGS. 1 and 2) is highly preferred for user safety and product durability. The size and shape of any such cover can be varied to convenience, but usually it is designed to cover the complete workings of the strumming mechanism 6 (FIGS. 1 and 2). Other safety features can include quick-release wiring 32 and 37 (FIG. 5) to connect the motor 13 (FIGS. 5, 6 and 7) to the controller 7 (FIGS. 1, 2), along with an on/off control switch 33 (FIG. 5) to act as a "kill switch" for the motor 13 in the case of an emergency. For additional safety, the base 5 (FIGS. 1, 2, and 3) and all fabricated parts can be and preferably are constructed with radius edges. The lifting handles 14 (FIGS. 1 through 4) are for safety and convenience in handling. Such handles 14 can be constructed of steel or any similar such material and shaped for operational convenience.

While the invention has been described, illustrated, and disclosed in various forms of embodiment or modifications, the scope of the invention is not intended to be, nor should it be deemed to be, limited thereby. Such other modifications or embodiments as may be suggested by the teachings herein are particularly covered, as they fall within the breadth and scope of the appended claims.

We claim:

1. A modular automated assistive guitar that comprises four subsystems/modules (i.e., a base assembly, a pick assembly, a strumming mechanism and a fretting mechanism) in combination with a guitar to form an automated musical device that can be played by an individual with a range of mental and physical abilities wherein said modular automated assistive guitar comprises:

(a) a base assembly module having a substantially flat surface that is appropriately sized and shaped to receive a guitar, and that comprises fastening means to securely fasten a guitar to the base;

(b) a pick assembly module that provides means for strumming the guitar comprising a pick held in resilient contact with the strings of the guitar as the pick moves in a forward direction and a reverse direction across the strings of the guitar; said pick assembly module being located above the strings of the body of the guitar and fixedly attached to the strumming mechanism;

(c) a strumming mechanism module that comprises a moving slider (strumming bearing) that is slidably mounted on and runs the length of a linear (strumming) guide and connected to said pick assembly; wherein the moving slider and pick assembly are jointly and rotatably connected to a connecting rod, which in turn is rotatably connected to a crank and motor means for turning said crank at variable rates at the option or discretion of an operator, thereby causing the pick assembly mounted on the moving slider (strumming bearing) to reciprocate along the length of the linear (strumming) guide and causing the pick assembly to reciprocate perpendicularly across the strings of the guitar; and (d) a fretting mechanism module that comprises a slider base plate fixedly attached to two linear bearings which, in turn, are slidably mounted on two linear guides of a fretting clamp on either side of the neck of the guitar, said linear guides and fretting clamp being fixedly attached to the base assembly module, a slide that is mounted to traverse the neck of the guitar and is in slideable contact with the strings of the guitar, and means for compressing the slide against the strings of the guitar at variable times and pressures at the option or discretion of an operator.

* * * * *